US005377981A

United States Patent [19]

Monneret

[11] Patent Number: 5,377,981

[45] Date of Patent: * Jan. 3, 1995

[54] FIGURINE SUPPORT ROD AND FIGURINE ASSEMBLY FOR TABLE FOOTBALL

[75] Inventor: Alain Monneret, Montain, France

[73] Assignee: Monneret Jouets, Lons-le-Saunier, France

[ * ] Notice: The portion of the term of this patent subsequent to Aug. 11, 2009 has been disclaimed.

[21] Appl. No.: 102,066

[22] Filed: Aug. 4, 1993

[30] Foreign Application Priority Data

Aug. 20, 1992 [FR] France ..... 92 10273

[51] Int. Cl.[6] ..... A63F 7/06

[52] U.S. Cl. ..... 273/85 D

[58] Field of Search ..... 273/85 R, 85 C, 85 D, 273/129 R, 119 R

[56] References Cited

U.S. PATENT DOCUMENTS

| | | | |
|---|---|---|---|
| 4,046,378 | 9/1977 | Furr | 273/85 D |
| 4,138,110 | 2/1979 | Hendrickson | 273/85 D |
| 5,137,276 | 8/1992 | Monneret | 273/85 D |

FOREIGN PATENT DOCUMENTS

| | | | |
|---|---|---|---|
| 494821 | 7/1950 | Belgium . | |
| 497144 | 11/1950 | Belgium | 273/85 D |
| 852821 | 7/1977 | Belgium . | |
| 0316989 | 5/1989 | European Pat. Off. . | |
| 980203 | 5/1951 | France | 273/85 D |
| 1034971 | 8/1953 | France | 273/85 D |
| 2072774 | 9/1971 | France . | |
| 2601599 | 1/1988 | France . | |
| 2666241 | 3/1992 | France . | |
| 197003 | 7/1938 | Switzerland . | |
| 390764 | 8/1965 | Switzerland | 273/85 D |

*Primary Examiner*—Sebastiano Passaniti
*Attorney, Agent, or Firm*—Oliff & Berridge

[57] ABSTRACT

A table football figurine includes of two complementary pieces, a male piece and a female piece, respectively, which can be assembled together after engagement of a notch onto a rod segment. A bottom of the notch is shaped so as to match the rod segment. Each rod segment is capable of receiving a figurine and has at least one hollowed-out deformation, which does not open outwardly. The notch of at least one of the two pieces constituting each figurine has, in correspondence with each hollowed-out deformation of the rod segment, a projection of complementary shape capable of engaging, without play, in the corresponding hollowed-out deformation of the rod segment.

13 Claims, 2 Drawing Sheets

FIG 1
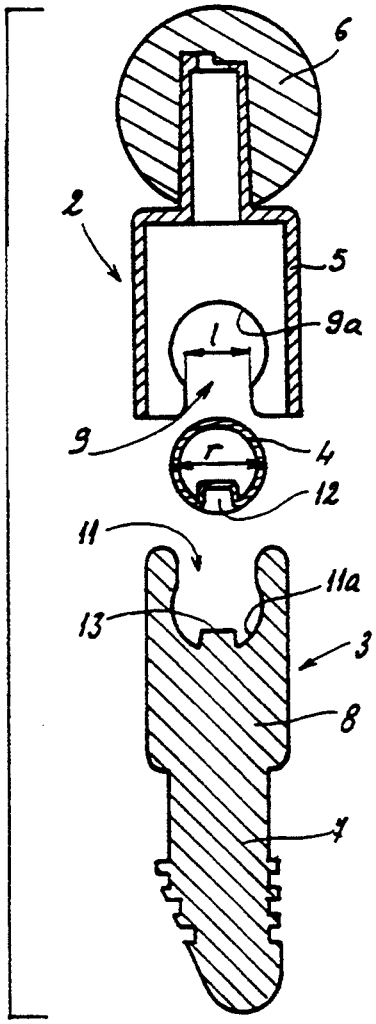
FIG 2
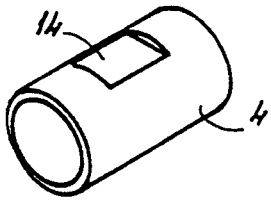
FIG 3
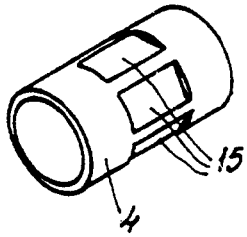
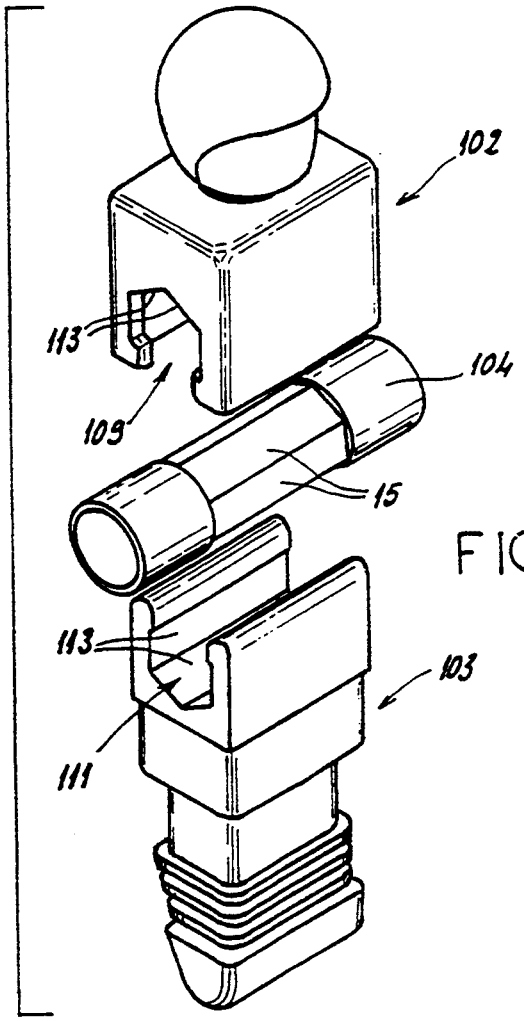
FIG 4

FIGURINE SUPPORT ROD AND FIGURINE ASSEMBLY FOR TABLE FOOTBALL

DESCRIPTION OF THE PRIOR ART

French Patent Application 90 11054, in the name of the Applicant, discloses a figurine for table football consisting of two complementary pieces, a male piece and a female piece, respectively, each of which is arranged to be capable of being assembled to the other by partial nesting and wedging and/or snap-fitting, both of them totally clasping the rod segment on which they are fastened, each of these pieces having, at its assembly end, a notch whose bottom has a cross section which is substantially identical to the corresponding halfcross section of the abovementioned rod segment.

According to this document, the female piece represents the head and the torso of the figurine, while the male piece represents its legs and its pelvis, and that of the two pieces constituting a figurine which has a male assembly end has, in the bottom of its notch, a radial protuberance and the rod segment in question has an aperture whose perimeter corresponds to the cross section of the protuberance and which is intended to receive it in order to constitute therewith the means for linking the figurine to the rod in rotation and in translation.

Unfortunately, it has been revealed that the burrs and the cutting edges inevitably presented by the edges of the aperture punched in the rod segment rapidly gave rise to sectioning of the abovementioned protuberance, thus destroying any link between the figurine and the rod.

To remedy this, a metal insert, overmolded at the time of molding of this piece, was placed in the notch bottom of the figurine piece which was to possess this protuberance, with the drawback of a considerable increase in the cost price of this figurine.

SUMMARY OF THE INVENTION

The present invention aims to remedy these drawbacks.

To this end, in the assembly to which it relates, each figurine consists of two complementary pieces, a male piece and a female piece, respectively, which can be assembled together by sliding, wedging and/or snap-fitting, after engagement on the rod segment intended to receive the figurine of a notch with which each is provided and whose bottom is shaped so as to match the abovementioned rod segment. Each rod segment capable of receiving a figurine has at least one hollowed-out deformation which does not open out. The notch of at least one of the two pieces constituting each figurine has, in correspondence with each hollowed-out deformation of the rod segment in question, a projection of complementary shape capable of engaging, without play, in the corresponding hollowed-out deformation of the rod.

Thus, whether the hollowed-out deformations of the rod segments are obtained by deep-drawing or not, the fact that they do not open out eliminates any risk of the presence of burrs or cutting edges capable of giving rise to the premature shearing of the corresponding notch projections.

The result of this is that these projections may be obtained by molding, when the figurines are manufactured, and that it is no longer necessary to form them from expensive metal inserts which are subject to corrosion.

Moreover, the presence of the apertures gives rise to embrittlement of the rod, whereas the pressings, on the other hand, have the advantage of stiffening it.

It should also be noted that a pressing is easier to produce than an aperture.

According to a first embodiment of the invention, each rod segment capable of receiving a figurine has a single hollowed-out deformation having the shape of a cylindrical or frustoconical well and with an axis of revolution oriented radially with respect to the axis of the rod, and the notch bottom of one of the pieces constituting each figurine has a projection in the form of a cylindrical or frustoconical stud with dimensions complementing those of the cylindrical well of the rod and capable of being engaged, without play, in this well, at the end of engagement of the notch of this element on the rod section.

According to a further embodiment of the invention, each rod segment intended to receive a figurine has at least one pressing of V-shaped cross section, oriented normally to the axis of the rod, and the corresponding part of the notch wall of the male piece of the figurine has a complementary projection capable of engaging, without play, in the abovementioned pressing, during mounting of the male piece on the rod.

Preferably, provision is made for two diametrically opposed pressings and, consequently, two complementary projections borne by the two opposite lateral walls of the notch of the male piece of the figurine.

According to a variant embodiment of the invention, each hollowed-out deformation of each rod segment capable of receiving a figurine consists of a hollowed-out flat and the corresponding sector of the notch of the piece constituting the figurine intended to be in correspondence with the abovementioned flat has a projecting flat, of a dimension corresponding to that of this rod segment and capable of matching it at the end of engagement of the notch of the abovementioned figurine piece on this rod segment.

Provision may also be made, both on each rod segment intended to receive a figurine and on the corresponding sector of the notch of one or the other piece of the figurine, for a single flat. However, preferably, provision is made, on each abovementioned rod segment, for several hollowed-out, uniformly distributed flats, giving it a polygonal contour, such as a hexagonal or octagonal contour, and the notch bottom of at least one figurine piece has a complementary polygonal contour such that, after engagement of the notches of the two figurine elements and their assembly together, the two notch bottoms of these two elements at least partially match the polygonal contour of the rod segment.

Naturally, the length of the deformations in the form of flats of the rod segments is substantially equal to that of the complementary projecting flats of the notches of figurine elements, but this length may be equal to or shorter than the width of the figurines.

It should be noted that, in all cases, the interpenetration of the projections of the notches of the pieces constituting the figurines and of the hollowed-out deformations of the rod segments ensures not only the linking of the figurines to the rod in rotation but also their axial immobilization with respect to this rod.

One of the two pieces constituting a figurine may, as in the abovementioned French patent application, correspond to the head and to the torso of this figurine, and the other of the two pieces may correspond to its legs and to its pelvis, each of them including an extension permitting their assembly by means of a partial nesting and the notches of each of them being open in the direction of this extension.

However, according to a variant, one of the pieces of this figurine represents virtually all of the figurine and its notch is open in the direction of its abdomen or of its back, while the second piece constitutes the male piece which can be engaged both on the chosen rod segment and in the notch of the other piece, reproducing, as appropriate, the abdomen or the back of this figurine.

According to a first embodiment of this variant, the second piece or male piece can be engaged in the notch of the other piece in a radial direction with respect to the axis of the rod, and its retention, after engagement, is obtained by its snap-fitting and/or its wedging at the end of engagement.

According to a second embodiment of this variant, the second piece or male piece of this figurine can be engaged in the notch of the other piece by sliding parallel to the axis of the rod, the edges of the notch of the first piece being provided with a male or female dovetail profile, while the corresponding edges of the second piece are provided with a complementary profile and its retention is ensured by snap-fitting and/or wedging.

DESCRIPTION OF THE DRAWING

In any case, the invention will be better understood with the aid of the following description made with reference to the appended diagrammatic drawing which represents, by way of non-limiting examples, several embodiments of this assembly:

FIG. 1 is an exploded sectional view, radial with respect to the axis of the figurine-holder rod, showing the two male and female pieces of this figurine in the position prior to assembly on the rod in the case where the segment of the latter, intended to receive this figurine, has a substantially frustoconical pressing;

FIGS. 2 and 3 are partial perspective views showing a rod segment having, respectively, two pressings different from that in the example illustrated by FIG. 1;

FIG. 4 is an exploded perspective view showing the two female and male component parts of a figurine in the position prior to assembly on a rod segment in accordance with that illustrated by FIG. 3;

DESCRIPTION OF THE PREFERRED EMBODIMENTS

Figure 5:
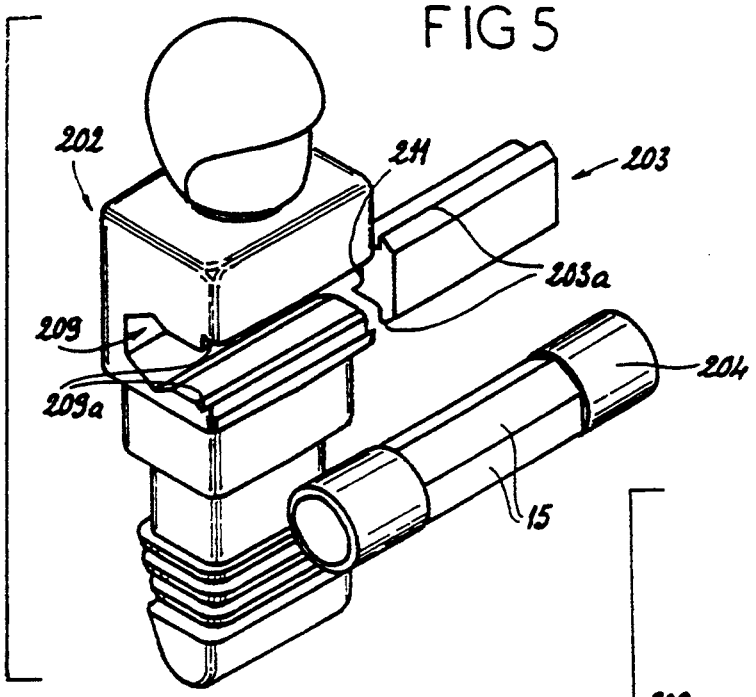
FIG. 5 is a view similar to FIG. 4, illustrating a variant embodiment of the figurine in FIG. 4.

FIG. 1 is an exploded cross-sectional view showing the two component parts, made from molded or injection-molded plastic, of a figurine, namely the female piece 2 and the male piece 3 intended to be assembled on a table-football rod 4 by being linked to it in rotation and axially.

In this example, the female piece 2 represents the torso 5 and the head 6 of the figurine, while the male piece 3 represents its legs 7 and its pelvis 8.

In this example, the head 6 is fixed to the torso 5 by conical wedging, but, obviously, the head 6 and torso 5 assembly could be made in a single piece.

As was the case in the patent application cited at the beginning of the description of the present application, each female 2 and male 3 piece of this figurine has, at its assembly end, an opening-out notch 9 and 11, respectively, whose bottom 9*a* and 11*a*, respectively, has a partially cylindrical shape with a radius substantially equal to that r of the rod 4.

As the drawing shows, the cylindrical bottoms 9*a* and 11*a* of the notches 9 and 11 of the pieces 2 and 3 develop over a sector slightly greater than 180° so that the width 1 of their opening is slightly smaller than the external radius r of the rod 4. The engagement of the two pieces 2 and 3 on the rod 4 as far as the bottom of the notches 9 and 11 can thus be achieved only by virtue of the elasticity of their constituent material, this elasticity ensuring their retention by snap-fitting on the rod 4.

Moreover, as emerges from an examination of FIG. 1, each component piece 2 and 3 of this figurine has an extension beyond its notch 9 and 11, respectively, so as to permit their partial nesting at the time of their reciprocal assembly on the rod 4.

It should, moreover, be noted that the engagement of the female piece 2 on the rod 4 and on the male piece 5 has the effect of ensuring the blocking of the male piece 3, since the assembly end of the latter is trapped inside the assembly end of the female piece 2. This arrangement is advantageous since, during a table-football match, it is actually the male piece 3 which experiences the greatest stresses, since it is with the aid of the feet or legs 7 of the figurines that the ball constituting the football is struck.

In the example illustrated in FIG. 1, the means for assembling the figurine 2, 3 to the segment of the rod 4 intended to receive it comprise, on the one hand, a hollowed-out deformation 12 produced by deep-drawing on the rod 4 and, on the other hand, a protuberance 13 provided in the bottom of the notch 11 of the male piece 3 and which is intended to be engaged in the hollowed-out deformation 12 of the segment in question of the rod 4.

In this example, the hollowed-out deformation 12 of the rod 4 has the shape of a well of substantially frustoconical shape and, naturally, the protuberance 13 has a complementary shape.

It should be noted that the production of the hollowed-out deformation 12 of the rod 4, by deep-drawing, does not cause the formation of any burr nor any cutting edge capable of giving rise to the deterioration and, in particular, the sectioning of the protuberance 13. Consequently, the latter does not have to be produced, although this is possible, by means of a metal insert overmolded during manufacture, by molding, of the male piece 3.

FIG. 2 shows, in perspective, a segment of the rod 4 intended to receive a figurine, in which the hollowed-out deformation involved in the rotational and axial link of the figurine to this rod segment consists of a flat 14 oriented parallel to the axis of the rod 4 or two diametrically opposed flats 14.

The example of FIG. 3 differs from that of FIG. 2 in that provision is made not for just one or two flats 14, but for six flats 15 uniformly distributed at the periphery of the rod 4 and arranged so as to be diametrically opposite in pairs.

FIG. 4 illustrates the method of assembling a figurine to a segment of the rod 4, in accordance with that illustrated by FIG. 3, that is to say having six flats or facets 15.

In this example, the parts already described in respect of FIG. 1 have been allocated the same references increased by one hundred.

The female 102 and male 103 pieces of the figurine and the rod 104 whose segment intended to receive this figurine has flats or facets 15 giving it a hexagonal cross section thus appear again.

As an examination of FIG. 4 shows, each notch 109 and 111 of the female 102 and male 103 pieces of this figurine has a plurality of projections consisting of flats 113 giving each of them a hexagonal contour of the same dimensions as the hexagonal cross section of the segment in question of the rod 104, and capable of matching, by completing each other, the hexagonal perimeter of this segment of the rod 104.

In this example, the length of the flats 15 of the segment of the rod 104 is equal to the length of the notches 109 and 111 of the pieces 102 and 103 of this figurine, that is to say to the width of this figurine. Naturally, it will be possible to provide flats 15 of a length shorter than the width of the figurine, but, in this case, the hexagonally shaped part of each notch 109 and 111 would have to have an adapted length.

These arrangements have the effect of providing, as a complement to the rotational link obtained by the non-circular cross section of the notches 109 and 111 and of the segment of the rod 104, an axial link of the figurine to the rod 104.

FIG. 5 illustrates, in perspective, a variant embodiment of the example illustrated by FIG. 4. In this example, the parts which correspond with one another have been allocated the same reference numbers as in FIG. 4, increased by one hundred.

In this example, the female piece 202 of the figurine represents virtually all this figurine and its notch 209 is open in the direction of the abdomen of this figurine, while its male piece 203 constitutes only its abdomen.

As shown in FIG. 5, this male piece 203 is intended to close the opening of the notch 209 of the female piece 202 and, to this end, each of the edges of the notch 209 has a longitudinal groove **209*a*, the pair of which form a dovetail-shaped slideway and, for its part, the male piece 203 has, along each of its edges, a rib 203*a* complementing a groove 209*a* of the notch 209 and capable of being engaged, in the slideway formed by these grooves 209*a***, in the manner of a slide and of being retained, at the end of engagement, by wedging and/or snap-fitting.

Naturally, tie male piece 203 has, at its end facing the notch 299 of the female piece 202, a groove 211 having that part of the facets of the hexagonal cross section of the segment in question of the rod 204 which is missing from the notch 209.

It may easily be understood that, after having engaged the female piece 202 on the segment in question of the rod 204, positioning of the male piece 203 ensures locking of the mounting of the figurine on this rod segment.

This figurine is thus linked axially and rotationally to the rod 204.

Figure 6:
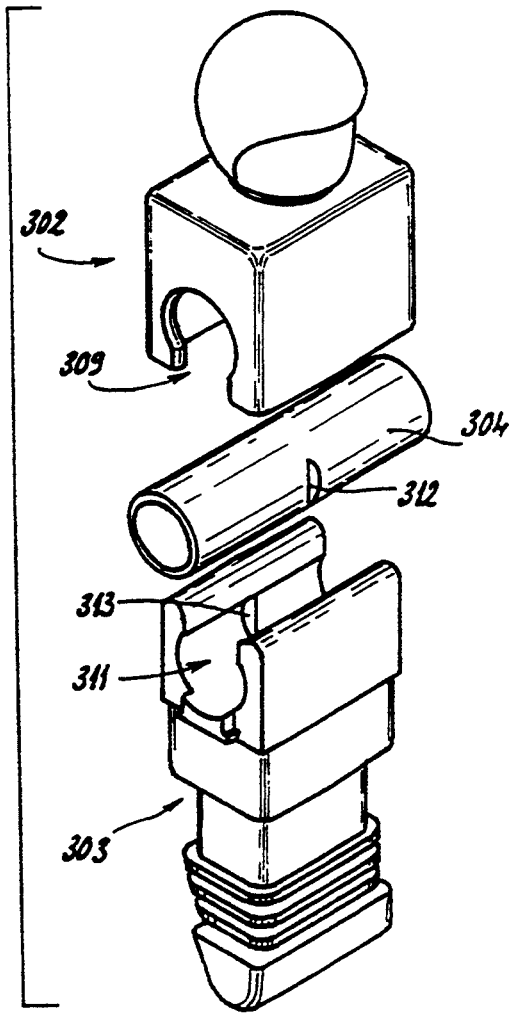
FIG. 6 is a view similar to FIG. 4, illustrating a variant embodiment of the rod segment intended to receive a figurine.

The example illustrated by FIG. 6 is inspired by that illustrated by FIG. 1 and the parts corresponding to those in FIG. 1 are denoted by the same references increased by three hundred.

As in the example illustrated by FIG. 1, this figurine thus has a female piece 302 and a male piece 303 whose assembly ends have notches 309 and 311, respectively, strictly in accordance with the notches 9 and 11 of the pieces 2 and 3 of the example in FIG. 1, that is to say having substantially the same radius r as the rod 304 and developing over a sector slightly greater than 180°.

In this example, the hollowed-out deformation with which the segment in question of the rod 304 is provided consists of a pressing 312 of V-shaped cross section and, preferably, of two diametrically opposed pressings 312, while two convex projections 313 with a shape complementing the pressings 312 of the segment of the rod 304 are produced on each of the lateral walls, opposite each other, of the notch 311 of the male piece 303 of this figurine.

As in the preceding examples, the assembly of the male piece 303 on the segment of the rod 304 intended to receive it, followed by the assembly of the female piece 302 on this same segment of the rod 304, with partial nesting of the assembly end of the male piece 303, ensures locking of the latter in its assembly position on the rod 304 and the rotational and axial linking of this figurine to the rod 304.

Figure 7:
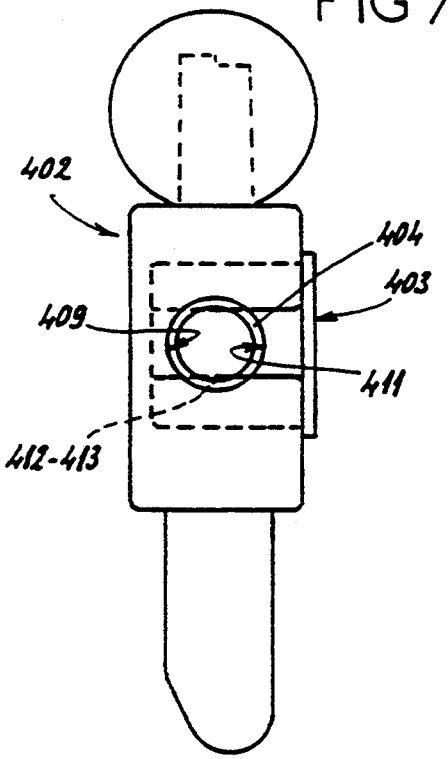
FIG. 7 is a cross-sectional view showing a figurine mounted on the rod segment intended to receive it and illustrating a variant embodiment of this figurine and its means of assembly on the rod.

FIG. 7 illustrates a variant embodiment of the example in FIG. 6, comparable to the variant illustrated by FIG. 5 of the embodiment illustrated by FIG. 4.

In this figure, the parts corresponding to parts already described in respect of FIG. 6 are denoted by the same references increased by one hundred.

In this example, the female piece 402 represents virtually all the figurine and its notch is open in the direction of the abdomen, while the male piece 403, which is intended to close the notch 409, represents only the abdomen of this figurine.

In this example, the male piece 403 has a notch 411 whose opposing walls are provided with projections 413 with a V-shaped cross section capable of being engaged in the pressings 412 produced on the segment in question of the rod 404.

Naturally, the projections 413 and the pressings 412 are strictly identical to the projections 313 and pressings 312 of the example illustrated in FIG. 6.

I claim:

1. A figurine support rod and figurine assembly for table football, comprising:

a rod segment having at least one hollowed-out deformation that does not open outwardly away from the rod segment; and a figurine comprised of a female piece and a complementary male piece that can be assembled together after engagement with the rod segment, each of the female piece and the male piece having a notch formed therein with a bottom shaped so as to match the rod segment, the notch of at least one of the female piece and the male piece including at least one projection of complementary shape engaging, without play, the corresponding at least one hollowed-out deformation of the rod segment.

2. The assembly as claimed in claim 1, wherein one of the female piece and male piece represents substantially all of the figurine and the notch of the one piece is open in the direction of a back, while the other piece constitutes the male piece which can be engaged both on the rod segment and in the notch of the one piece, reproducing the back of the figurine.

3. The assembly as claimed in claim 1, wherein the rod segment has a single hollowed-out deformation having the shape of a cylindrical or frustoconical well and with an axis of revolution oriented radially with respect to a longitudinal axis of the rod segment, and the bottom of the notch of one of the female piece and male piece has a projection in the shape of a cylindrical or frustoconical stud with dimensions complementing dimensions of the well of the rod segment and being engaged, without play, in the well.

4. The assembly as claimed in claim 1, wherein the rod segment has at least one pressing of V-shaped cross section, oriented normally to the axis of the rod segment, and a corresponding part of the notch of the male piece of the figurine has a complementary projection engaging, without play, the pressing, during mounting of the male piece on the rod segment.

5. The assembly as claimed in claim 4, wherein two diametrically opposed pressings are formed on the segment and two complementary projections are formed on opposing lateral walls of the notch of the male piece of the figurine.

6. The assembly as claimed in claim 1, wherein the hollowed-out deformation of the rod segment consists of a hollowed-out flat and a corresponding part of the notch of one of the male piece and the female piece has a projecting flat, of a dimension corresponding to a dimension of the hollowed-out flat of the rod segment.

7. The assembly as claimed in claim 6, wherein provision is made, on the rod segment, for several-hollowed-out, uniformly distributed flats, giving the rod segment a polygonal contour, and the bottom of the notch of at least one of the female piece and the male piece has a complementary polygonal contour such that, after engagement of the notches of the female piece and male piece, the bottom of the female piece and the male piece at least partially match the polygonal contour of the rod segment.

8. The assembly as claimed in claim 7, wherein a length of the flats of the rod segment is equal to a length of the corresponding flats of the notches and is also equal to a width of the figurine.

9. The assembly as claimed in claim 7, wherein a length of the flats of the rod segment is equal to a length of the corresponding flats of the notches and is shorter than a width of the figurine.

10. The assembly as claimed in claim 1, wherein one of the female piece and male piece reproduces a head and torso of the figurine whereas the other reproduces legs and a pelvis.

11. The assembly as claimed in claim 1, wherein one of the female piece and male piece represents virtually all of the figurine and the notch of the one piece is open in the direction of an abdomen, while the other piece constitutes the male piece which can be engaged both on the rod segment and in the notch of the one piece, reproducing the abdomen of the figurine.

12. The assembly as claimed in claim 11, wherein the male piece can be engaged in the notch of the female piece in a radial direction with respect to a longitudinal axis of the rod segment, and retention, after engagement, of the male piece is obtained by one of snap-fitting and wedging at the end of engagement.

13. The assembly as claimed in claim 11, wherein the male piece can be engaged in the notch of the female piece by sliding parallel to a longitudinal axis of the rod segment, edges of the notch of the male piece being provided with a dovetail profile, while corresponding edges of the female piece are provided with a complementary profile and retention of the male piece is ensured by one of snap-fitting and wedging.

* * * * *